US010285485B2

(12) United States Patent
Megaro et al.

(10) Patent No.: US 10,285,485 B2
(45) Date of Patent: May 14, 2019

(54) APPARATUS AND METHOD FOR DISPENSING FLUID

(71) Applicant: BlokRok, Inc., Chapel Hill, NC (US)

(72) Inventors: Arianna Megaro, Chapel Hill, NC (US); Matthew Megaro, Chapel Hill, NC (US); Brad Forrest, Cary, NC (US)

(73) Assignee: Blok Rok, Inc., Durham, NC (US)

( * ) Notice: Subject to any disclaimer, the term of this patent is extended or adjusted under 35 U.S.C. 154(b) by 0 days.

(21) Appl. No.: 15/470,134

(22) Filed: Mar. 27, 2017

(65) Prior Publication Data

US 2017/0273435 A1 Sep. 28, 2017

Related U.S. Application Data

(60) Provisional application No. 62/313,361, filed on Mar. 25, 2016.

(51) Int. Cl.
*B05C 17/035* (2006.01)
*A45D 34/04* (2006.01)
(Continued)

(52) U.S. Cl.
CPC ..... *A45D 34/041* (2013.01); *A45D 19/02* (2013.01); *A45D 34/04* (2013.01);
(Continued)

(58) Field of Classification Search
CPC . B05C 17/03; B05C 17/0316; B05C 17/0325; B05C 17/0357
(Continued)

(56) References Cited

U.S. PATENT DOCUMENTS 4,150,904 A 4/1979 Stewart
4,569,612 A 2/1986 Schwartzman et al.
(Continued)

FOREIGN PATENT DOCUMENTS

DE 29622034 U1 2/1997
DE 19611208 A1 9/1997
(Continued)

OTHER PUBLICATIONS

Blokrok, Inc., International Application No. PCT/US2015/026630, International Search Report and Written Opinion, dated Jul. 23, 2015.
(Continued)

*Primary Examiner* — David Walczak
*Assistant Examiner* — Joshua Wiljanen
(74) *Attorney, Agent, or Firm* — Taylor English Duma LLP

(57) ABSTRACT

An apparatus for dispensing a fluid from a source of fluid comprises a roller and a tray member. The tray member comprises a pair of spaced walls having a contiguous tapered inner surface for defining an arcuate recess in an outer surface of the tray member, the outer surface tapering to an outer edge of each wall. Roller mounting means includes a pair of resilient spaced arms, each one of the arms spanning between and interconnecting the ends of the spaced wall. The tray member defines a pair ports spaced along a central longitudinal axis of the tray member for providing fluid communication between the source of fluid and the tray member. The roller is rotatably mounted to the spaced arms for receiving fluid from the tray member and applying the fluid onto a surface.

22 Claims, 13 Drawing Sheets

(51) Int. Cl.
*A45D 19/02* (2006.01)
*B05B 11/00* (2006.01)
*B05C 17/03* (2006.01)

(52) U.S. Cl.
CPC ..... *B05B 11/0037* (2013.01); *B05B 11/0054* (2013.01); *A45D 2200/056* (2013.01); *B05C 17/0325* (2013.01)

(58) Field of Classification Search
USPC ..... 401/208, 219
See application file for complete search history.

(56) References Cited

U.S. PATENT DOCUMENTS

| | | | | |
|---|---|---|---|---|
| 4,669,637 | A | 6/1987 | Fiocco et al. | |
| 4,812,071 | A | 3/1989 | Batra et al. | |
| 4,813,463 | A | 3/1989 | Lin | |
| 5,056,949 | A | 10/1991 | Petrillo | |
| 5,152,305 | A | 10/1992 | Niv | |
| 5,482,393 | A | 1/1996 | Sekiguchi et al. | |
| 5,516,223 | A | 5/1996 | Matz et al. | |
| 5,716,151 | A | 2/1998 | Satake | |
| 5,888,007 | A | 3/1999 | Nicoll et al. | |
| 5,899,624 | A | 5/1999 | Thompson | |
| 6,244,776 | B1 | 6/2001 | Wiley | |
| 6,406,207 | B1 | 6/2002 | Wiegner et al. | |
| 6,505,986 | B1 | 1/2003 | Oder | |
| 6,682,246 | B2 | 1/2004 | Reggiani | |
| 6,729,788 | B2 | 5/2004 | Bouveresse | |
| 6,883,996 | B2 | 4/2005 | Ishida | |
| 7,101,106 | B1 | 9/2006 | Wiley | |
| 7,153,053 | B1 * | 12/2006 | Wiley | A45D 34/041 401/219 |
| 7,226,231 | B2 | 6/2007 | Py et al. | |
| 7,658,568 | B1 | 2/2010 | Armstrong et al. | |
| 8,262,592 | B1 | 9/2012 | Brooks et al. | |
| 8,757,914 | B1 | 6/2014 | Megaro et al. | |
| 9,468,279 | B2 | 10/2016 | Megaro et al. | |
| 2002/0007839 | A1 | 1/2002 | Gueret | |
| 2005/0249540 | A1 | 11/2005 | Gueret | |
| 2008/0138144 | A1 | 6/2008 | Kennedy et al. | |
| 2008/0145136 | A1 | 6/2008 | Korper | |
| 2011/0250006 | A1 | 10/2011 | Song | |
| 2011/0250008 | A1 | 10/2011 | Lim | |
| 2012/0045270 | A1 | 2/2012 | Apodaca et al. | |
| 2012/0321368 | A1 | 12/2012 | Lim | |
| 2015/0296957 | A1 | 10/2015 | Megaro et al. | |
| 2016/0029770 | A1 | 2/2016 | Megaro et al. | |
| 2017/0035180 | A1 | 2/2017 | Megaro et al. | |

FOREIGN PATENT DOCUMENTS

| | | | |
|---|---|---|---|
| EP | 0155616 | A2 | 9/1985 |
| EP | 2361527 | A1 | 8/2011 |
| FR | 2708314 | A1 | 2/1995 |
| WO | 9015567 | A1 | 12/1990 |
| WO | 0021685 | A1 | 4/2000 |

OTHER PUBLICATIONS

Blokrok, Inc., International Application No. PCT/US2014/027608, International Search Report and Written Opinion, dated Jul. 17, 2014.
Blokrok, Inc., International Application No. PCT/US2014/027608, International Preliminary Report on Patentability, dated Sep. 24, 2015.
U.S. Appl. No. 13/833,813, Office Action, dated Sep. 30, 2013.
U.S. Appl. No. 14/777,049, Office Action, dated Apr. 13, 2017.
U.S. Appl. No. 14/257,507, Office Action, dated Dec. 7, 2015.

* cited by examiner

APPARATUS AND METHOD FOR DISPENSING FLUID

CROSS-REFERENCE

This application is related to U.S. provisional application No. 62/313,361, filed Mar. 25, 2016, entitled "APPARATUS AND METHOD FOR DISPENSING FLUID", naming Arianna Megaro, Matthew Megaro, and Brad Forrest as the inventors. The contents of the provisional application are incorporated herein by reference in their entirety, and the benefit of the filing date of the provisional application is hereby claimed for all purposes that are legally served by such claim for the benefit of the filing date.

BACKGROUND

An apparatus and method for dispensing fluid is described and, more particularly, an apparatus and method is described for dispensing fluid on the skin.

There are numerous hand held and manipulated fluid applicators for dispensing a fluid, such as lotion, on the skin. Bottles or tubes containing fluid typically require the user to first pour or pump fluid onto their palms and then spread the fluid from their palms onto their skin. The process can be both tedious and messy and make it difficult to apply uniform layers of lotion.

Fluid applicators that are configured to attach to the bottles or tubes are sometimes used. In some fluid applicators, a fluid supply mechanism, such as a pump, is provided to deliver fluid from the bottle or tube to the applicator. Other fluid applicators are combined with a squeezable container allowing the user to force fluid to the fluid applicator by compressing the container. The fluid applicators typically comprise a head for delivering fluid from the container to a roller or a pad made of felt or other porous resilient material which contacts the skin. However, this type of fluid applicator is limited to use with less viscous fluids, which are capable of passing through porous material, and is less well suited for delivering more viscous fluids, such as sunscreen. Further, such applicators do not provide fluid control necessary for rapidly applying uniform layers of lotion while affording benefits of limited mess and cleanup.

For the foregoing reasons, there is a need for a new apparatus and method for dispensing a fluid. The new apparatus and method should provide fluid application to the skin in a less messy and more effective manner than conventional applicators used for fluid delivery. The new apparatus and method should ideally provide consistent, efficient fluid delivery of viscous fluids.

SUMMARY

An apparatus is described for dispensing a fluid from a source of fluid onto a surface. The fluid dispensing apparatus comprises a roller and a tray member having an outer surface and adapted to be in fluid communication with the fluid source. The tray member defining a pair of ports spaced along a central longitudinal axis of the tray member. The pair of ports provide fluid communication between the source of fluid and the tray member for delivering fluid to the outer surface of the tray member. The tray member comprises a pair of spaced walls having a contiguous tapered inner surface for defining an arcuate recess, the inner surface tapering to an outer edge of each wall. Means for mounting the roller includes a pair of resilient spaced arms, each one of the arms spanning between and interconnecting the ends of the spaced walls. The roller is rotatably mounted to the spaced arms for receiving fluid from the outer surface of the tray member and applying the fluid onto the surface.

In another aspect, a fluid dispensing apparatus comprises a housing defining an interior adapted to hold the fluid and having an opening into the interior. The housing is formed from a flexibly resilient material for transferring fluid from the housing via the opening by varying pressure on the housing. A fluid applicator assembly is mounted on the housing in fluid communication with the opening into the interior of the housing for delivering the fluid to the applicator assembly. The applicator assembly includes a fluid delivery element that is held in contact against a surface for applying the fluid onto the surface, and a tray member adapted to be in fluid communication with the fluid source. The tray member comprises a pair of spaced walls having a contiguous tapered inner surface for defining an arcuate recess in an outer surface of the tray member, the outer surface tapering to an outer edge of each wall, and means for mounting the fluid delivery element. Manual pressure on the housing reduces the volume of the interior for forcing fluid to the fluid applicator assembly such that fluid is delivered to the fluid delivery element for dispensing the fluid onto the surface.

BRIEF DESCRIPTION OF THE DRAWINGS

For a more complete understanding of the apparatus for dispensing fluid, reference should now be had to the embodiments shown in the accompanying drawings and described below. In the drawings.

DESCRIPTION

The contents of U.S. Pat. No. 8,757,914, which issued Jun. 24, 2014, and U.S. patent application Ser. No. 14/257,507, which was published as U.S. Pub. Application No. 2015/0296957 on Oct. 22, 2015, are incorporated herein by reference in their entirety.

Certain terminology is used herein for convenience only and is not to be taken as a limiting. For example, words such as "upper," "lower," "left," "right," "horizontal," "vertical," "upward," "downward," "top" and "bottom" merely describe the configurations shown in the FIGS. Indeed, the components may be oriented in any direction and the terminology, therefore, should be understood as encompassing such variations unless specified otherwise. The words "inner" and "outer" and "interior" and "exterior" refer to directions toward and away from, respectively, the geometric center of the core and designated parts thereof. The terminology includes the words specifically mentioned above, derivatives thereof and words of similar import.

Figure 1:
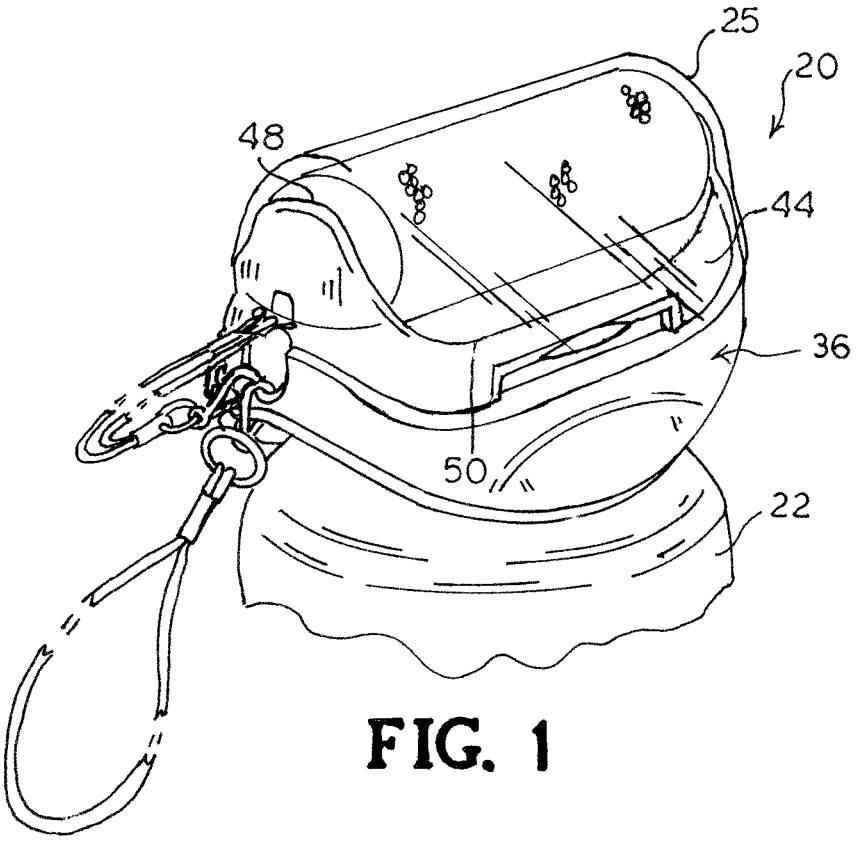
FIG. 1 is a perspective view of an embodiment of an apparatus for dispensing fluid in combination with a partially cut-away source of fluid.
Figure 2:
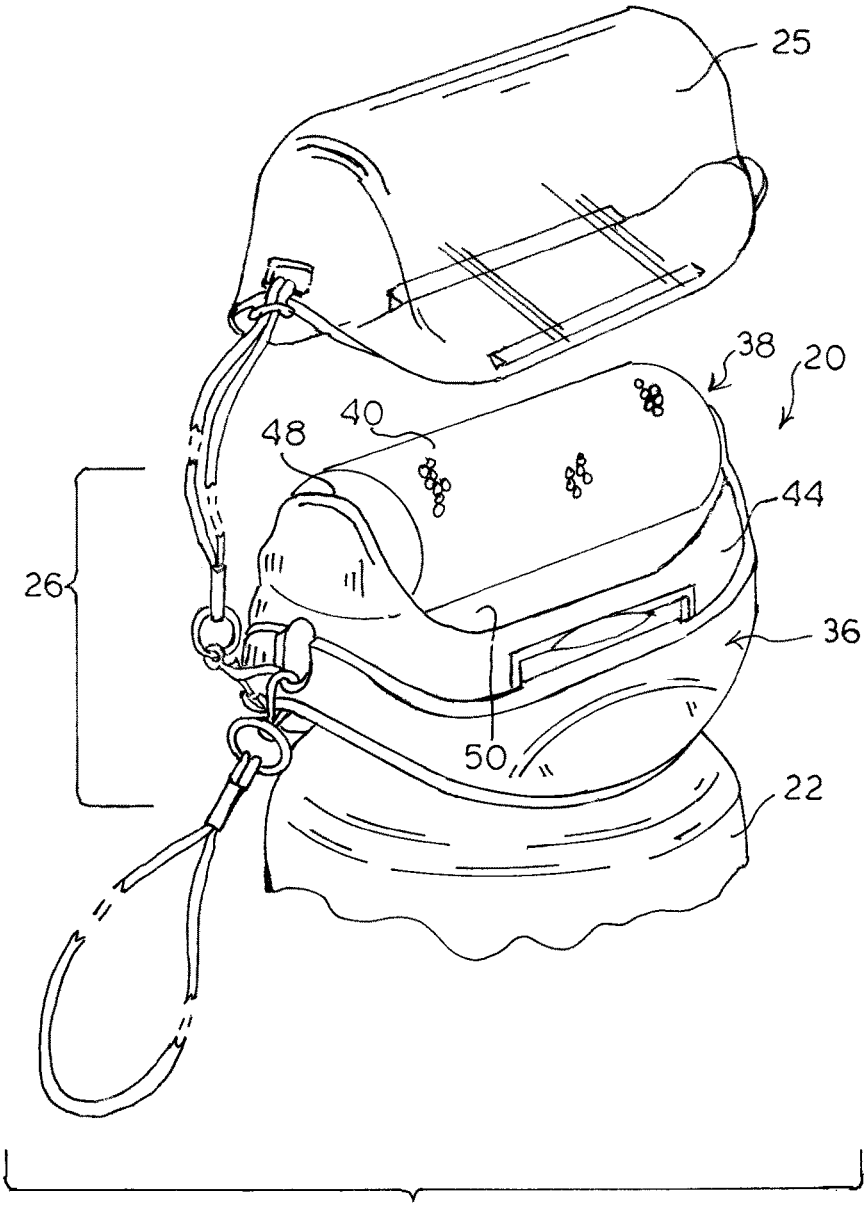
FIG. 2 is a perspective view of the fluid dispensing apparatus as shown in FIG. 1 with a cap removed.
Figure 3:
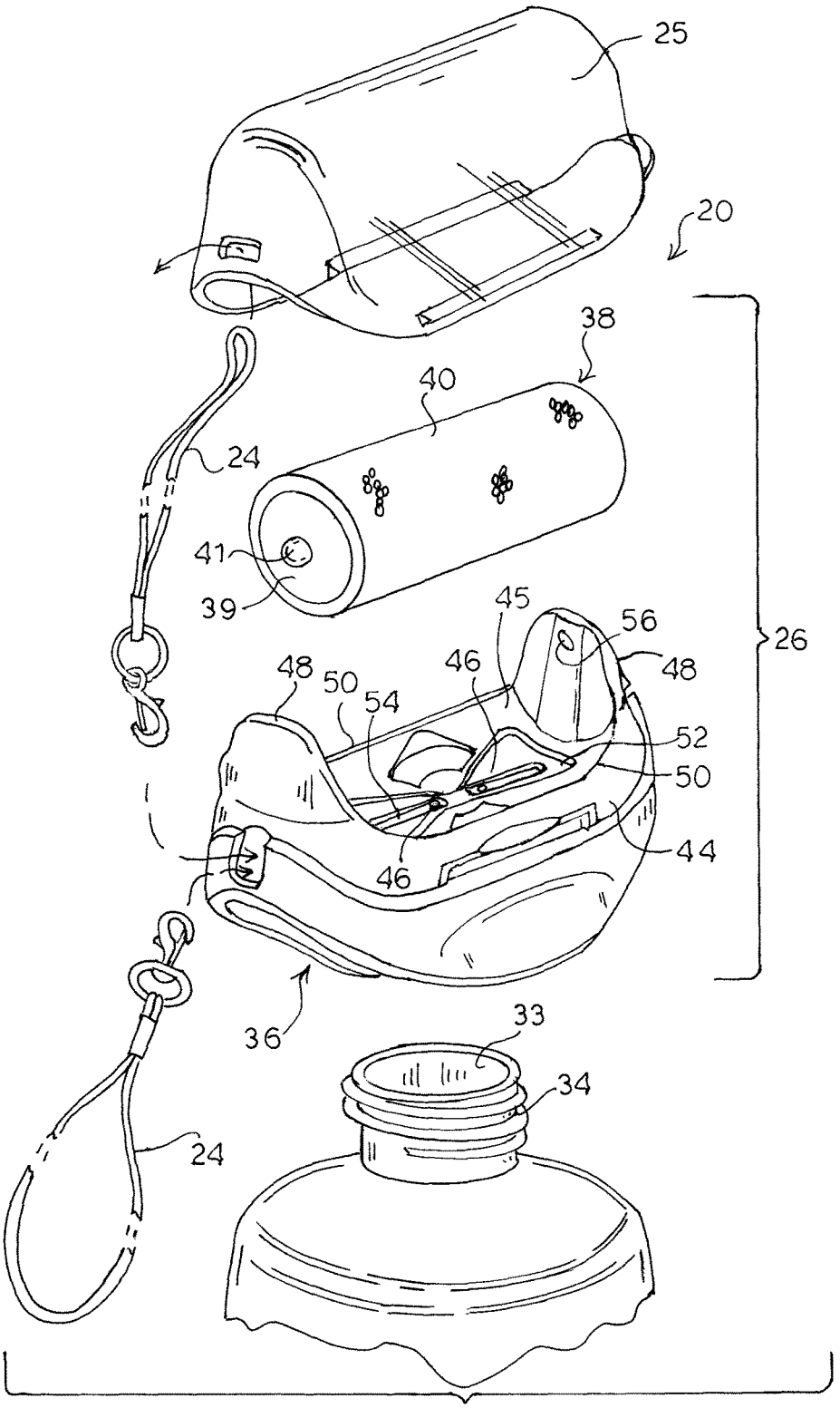
FIG. 3 is an exploded perspective view of the fluid dispensing apparatus as shown in FIG. 1.
Figure 4:
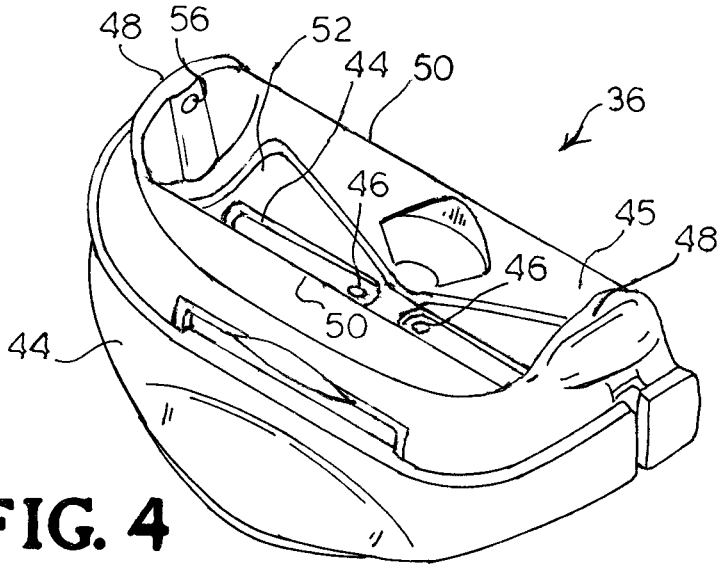
FIG. 4 is a top perspective view of an embodiment of an upload tray member for use in the fluid dispensing apparatus as shown in FIG. 1.
Figure 5:
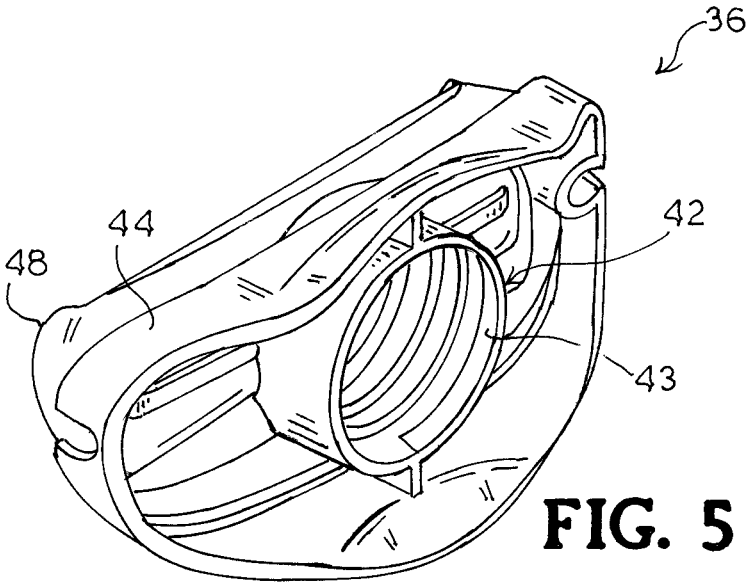
FIG. 5 is a bottom perspective view of the upload tray member as shown in FIG. 4.
Figure 6:
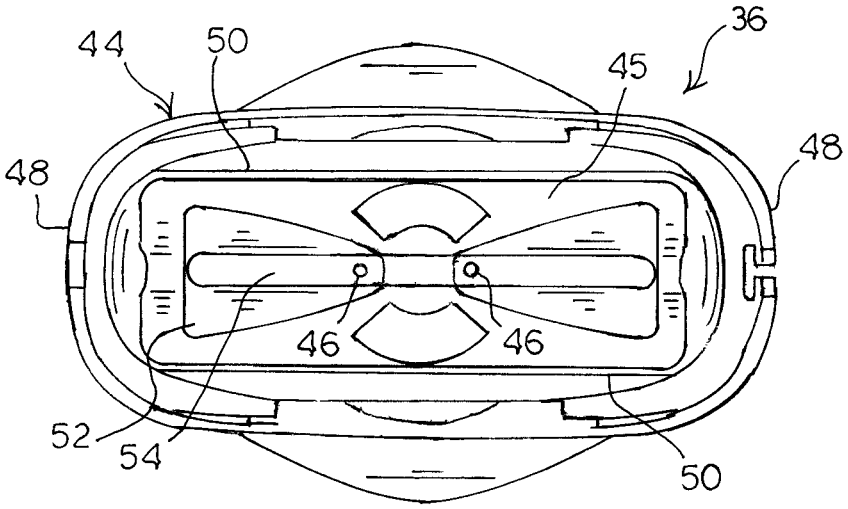
FIG. 6 is a top plan view of the upload tray member as shown in FIG. 4.
Figure 7:
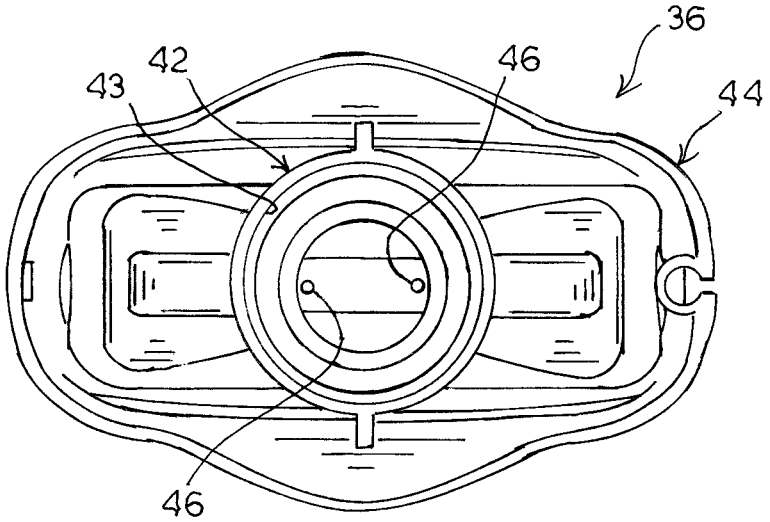
FIG. 7 is a bottom plan view of the upload tray member as shown in FIG. 4.
Figure 8:
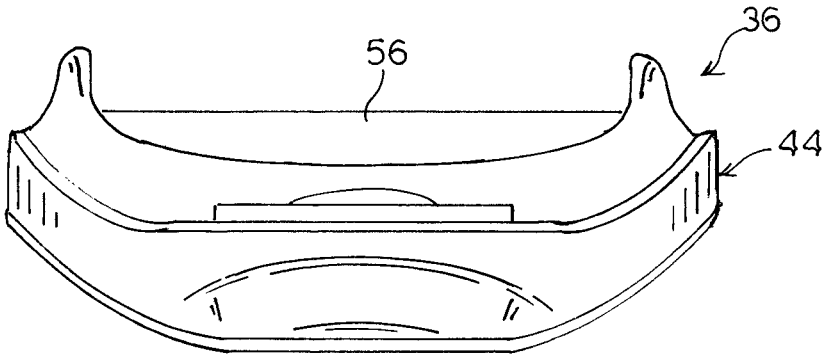
FIG. 8 is an elevation view of the upload tray member as shown in FIG. 4.
Figure 9:
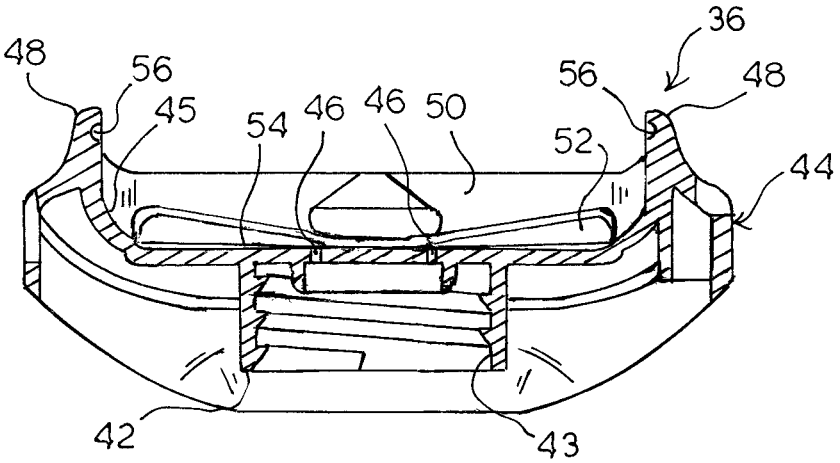
FIG. 9 is a longitudinal cross-section view of the upload tray member as shown in FIG. 4 taken along line 9-9 of FIG. 6.
Figure 10:
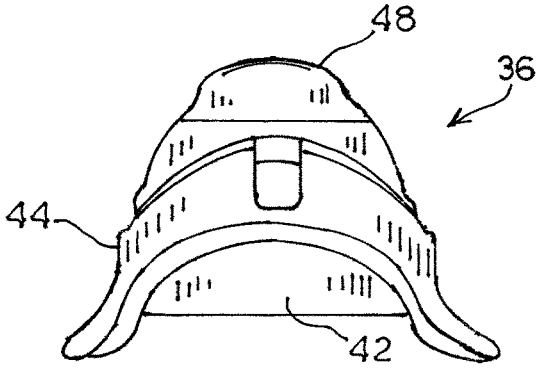
FIG. 10 is a left side elevation view of the upload tray member as shown in FIG. 4.
Figure 11:
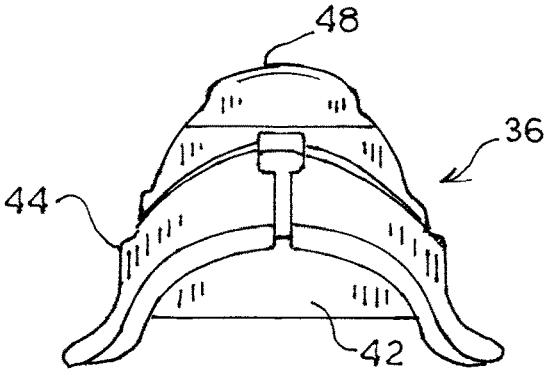
FIG. 11 is a right side elevation view of the upload tray member as shown in FIG. 4.
Figure 12:
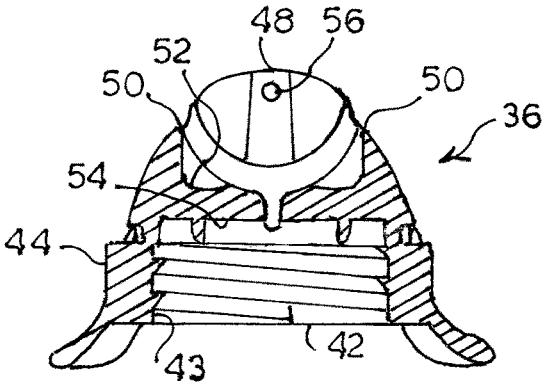
FIG. 12 is a transverse cross-section view of the upload tray member as shown in FIG. 4 taken along line 12-12 of FIG. 6.

Referring now to the drawings, wherein like reference numerals designate corresponding or similar elements throughout the several views, an apparatus for dispensing a fluid is shown in FIGS. 1-3 and generally designated at 20. The fluid dispensing apparatus 20 is adapted to be attached to conventional fluid containers, such as bottles or tubes, for controlled delivery of fluid by applying pressure to the container. The fluid dispensing apparatus 20 comprises an applicator assembly 26 in fluid communication with the fluid container for applying the fluid on a surface, such as skin of a human body. The applicator assembly 26 comprises a fluid upload tray 36 and a roller head assembly 38, including a cylindrical roller 40. A removable cap 25 is provided for covering at least the roller 40 of the applicator assembly 26 when not in use. A lanyard 24 may be connected between the cap 25 and the upload tray 36.

The fluid container is a substantially hollow housing 22 defining an interior cavity 32 for holding fluid to be dispensed through an opening 33 at one end 34 of the housing 22. The housing 22 may be formed from rigid or semi-rigid polymers, including, but not limited to polyethylene terephthalate (PET) or high density polyethylene (HMDI). In one embodiment, the material of the housing 22 may be pliable such that fluid can be dispensed from the fluid container by manually squeezing, and thus compressing, the housing 22. Accordingly, the external configuration of the housing 22 may offer a natural grip for stability in the hand of a user. For example, the housing 22 may have rounded edges such that the housing fits comfortably and securely in the palm of the hand. Further, the exterior surface of the housing 22 may be designed to enhance gripping during the operation of not only squeezing, but also pressing the applicator assembly 26 against the surface on which the fluid is to be applied. It is understood that the dimensions of the housing 22 may vary depending on desired fluid volume to be contained within the housing 22, as well as other certain desired performance attributes. For example, a larger, longer housing 22 may extend the reach of a user during use and enable more and repeated fluid coverage, whereas a smaller housing will reduce the contained fluid volume, but enable easy storage and mobility, such as in a pocket. A housing 22 may also be made to be suitable for compliance with maximum volumes set by travel regulations. The preferred thickness of the material of the housing 22 should be sufficient to withstand impact on a hard surface when dropped and will depend on the material itself. It is understood that the housing 22 is not intended to be limited by the materials listed here, but may be carried out using any suitable synthetic or natural material which allows the construction and use of the fluid dispensing apparatus described herein and sufficient to meet strength, weight, and other desired characteristics.

The fluid upload tray 36 and the roller head assembly 38 of the applicator assembly 26 are configured and integrated to provide the user with a high degree of control over the rate and thickness of fluid flow to enhance the efficiency of fluid delivery to a surface. The fluid upload tray 36 receives and distributes fluid from the housing 22 for uptake on the roller 40, minimizes excessive fluid flow that may lead to leaks and spills, distributes the fluid to cause a more uniform uptake by the rotating roller 40, and applies a uniform coating of fluid to the surface. In particular, the applicator assembly 26 performs these operations while enabling the user to regulate the rate at which fluid is delivered and applied to the surface by varying the amount of pressure applied to the housing 22. For example, the user may choose to apply a small amount of pressure so as to minimize or stop the flow of fluid, as may be desirable in instances where the user wishes to operate the roller 40 on the surface to manage the fluid that is already applied without delivering additional fluid at that moment. The fluid upload tray 36 is configured to control the flow of fluid across a range of user pressure inputs to enable uniform uptake of fluid on the roller 40, reduced dripping, and to promote even discharge of fluid irrespective of the rate of rotation of the roller.

Referring to FIGS. 4-12, the upload tray 36 is an ovular elongated member. The upload tray 36 comprises an inner central attachment flange 42 (FIGS. 5, 7 and 9) and an outer tray base 44. The attachment flange 42 is cylindrical and defines a central axial bore 43 adapted for receiving the outer open end 34 of the housing 22. In the embodiment shown, the bore 43 is internally threaded for removable threaded attachment to the externally threaded end 34 of the housing 22. The upload tray 36 is configured such that a portion of the one end 34 of the attached housing 22 fits within a cavity defined by a skirt 28 on the outer surface of the upload tray 36. In this arrangement, the upload tray 36 is in fluid communication with fluid in the housing 22 providing means for delivering fluid from the housing 22 through the attachment flange 42 to the outer tray base 44. Alternatively, an interference fit or a snap fit of the end 34 of the housing 22 into the bore 43 may be provided. A more permanent attachment alternative includes gluing or welding the end 34 of the housing 22 in the bore 43.

The outer tray base 44 is a generally planar component including outwardly projecting end walls 48 and spaced side walls 50 which interconnect the end walls 48. The end walls 48 and sidewalls 50 of the outer tray base 44 surround a concave outer surface 45. The end walls 48, sidewalls 50 and outer surface 45 of the outer tray base 44 together define an elongated recess 52. A pair of spaced central linear channels 54 is formed in the outer surface 45 of the tray base 44. Each channel 54 extends transversely along a midline substantially over the length of the recess 52 at the bottom of the outer tray base 44. The depth of each channel 54 increases from an inner end and along its length to the outer end of the channel 54. The channel opens into a depression 55 having an "hourglass" configuration, expanding outwardly in both directions from its midpoint. The depression 55 has a constant depth. The channel 54 and depression 55 enhance an even distribution of fluid along the outer tray base 44 for more uniform uptake by the full length of the roller 40, particularly at the ends of the roller 40. The increasing depth of the channels 54 and the width of the depression 55 toward their outer ends provide a larger fluid contact area for the roller 40 during rotation with the effect of a more balanced and uniform coating at the ends of the roller 40 that enhances the uniformity of fluid applied to the surface. In addition, the convergence of the side walls 50 at the end walls 48 limits the opportunity for fluid to flow under the ends of the roller 40, which could cause undesirable fluid accumulation. This configuration minimizes fluid dripping or delivery of excess fluid on the surface that would require repeated passage of the roller 40 to spread.

In one embodiment shown in the FIGS., the outer tray base 44 of the upload tray 36 has a pair of ports 46. Each port 46 opens into a channel 54 and is longitudinally spaced along the channel 54 equidistant from the midpoint of the depression 55. The fluid dispensing ports 46 open into the bore 43 of the attachment flange 42 for providing fluid communication between the bore 43 and the channels 54. Fluid is directed flow to each of the channels 54 in response to positive pressure on the housing 22 forcing fluid to pass from the housing 22, through the ports 46 and to the roller 40. The ports 46 may be sized to render the fluid dispensing apparatus 20 suitable for dispensing viscous fluids, such as sunscreen or other high viscosity bodily lotions. In one embodiment, the ports 46 are each about 1 mm in diameter for providing fluid flow. It is understood that the size of the openings for the ports 46 is dependent upon the desired amount of fluid to be delivered. An opening that is too large will deliver too much fluid that will overwhelm the roller 40 and reduce the control and uniformity of the fluid application. The size and spacing of the ports 46 may be adapted as required for controlled distribution and application of smaller or otherwise appropriate quantities of fluid. This sizing is dependent on the configuration of other components of the fluid dispensing apparatus 20, including the dimensions of the channels 54 and the depression 55, the surface area and texture of roller 40, and the degree of convergence of the end-walls 48 and sidewalls 50. It is understood that more than two ports could be positioned along the lengths of the channels 54 to further enhance fluid distribution to the roller 40. In another embodiment, the outer tray base 44 may have a single centrally positioned port (not shown) opening into the bore 43 of the attachment flange 42 for delivering fluid to both of the channels 54.

The upload tray 36 may be injection molded from a semi-rigid polymeric material, such as polypropylene. Commonly used rigid polymers such as polycarbonate and acrylonitrile butadiene styrene (ABS), maybe suitable in some fluid applications, but may suffer degradation after sustained contact with sunscreen. Polypropylene and certain cellulose plastics are appropriate for sustained exposure to sunscreen. A polypropylene/fiberglass resin provides greater rigidity than polypropylene and enhances the shape of the upload tray 36, particularly at points of tolerance, such as the edges of the side walls 50 and the roller axle retention cavities in the end walls. It is understood that the upload tray 36 may be molded from other suitable semi-rigid polymers or other resilient polymeric materials including, but not limited to a thermoplastic elastomer silicone, natural rubber, latex rubber, butyl rubber, nitrile rubber, or metal. It is understood that the scope of the fluid dispensing apparatus 20 is not intended to be limited by the materials listed here, but may be carried out using any material which allows the construction and operation of the fluid dispensing apparatus described herein.

Figure 13:
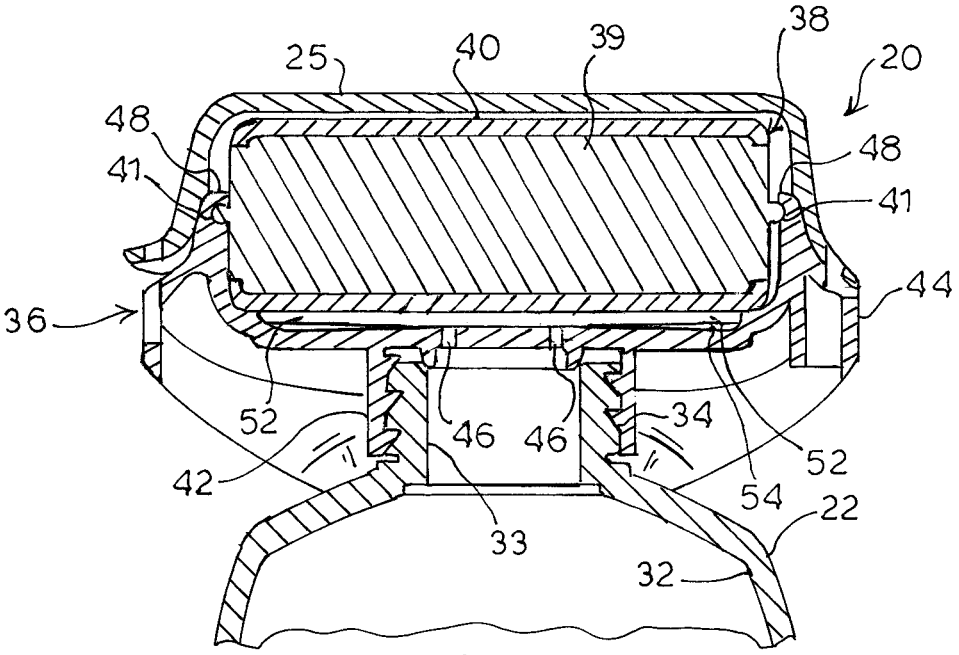
FIG. 13 is a longitudinal cross-section view of the fluid dispensing apparatus as shown in FIG. 1.

Referring to FIGS. 3 and 13, the roller 40 is an elongated cylindrical member comprising a rigid inner core 39 and a flexible outer sleeve. The inner core 39 of the roller to includes an axle 41 projecting from each end. The end walls 48, of the outer tray base 44 have opposed journal apertures 56 for receiving the corresponding axles 41 and rotatably supporting the roller 40 in the recess 52 of the outer tray base 44. The end walls 48 or the roller 40 may be sufficiently resilient to allow deformation so that the axle projections 41 may be selectively engaged with, or disengaged from, the upload tray 36 for attachment or removal, respectively, of the roller 40 from the outer tray base 44. The rigidity of the inner core 39 resists bowing during use, which would otherwise shorten the length of the roller 40 and cause the axles 41 to come loose from the apertures 56.

The flexible outer sleeve of the roller 40 provides a pliable surface for contacting the skin. In one embodiment, the roller 40 may have a textured surface, including grooves or projections of different sizes, shapes and geometries. The grooves or projections may also have different patterns or may be oriented at different angles with respect to the longitudinal axis of the roller 40, such as in zigzag, chevron, herringbone, hex, dot, or checkerboard patterns. The projections may represent raised areas spaced apart or interconnected to define one or more open channels. The grooves of channels may have a depth of about 0.005" to 0.05" for hard surface rollers and 0.005" to 0.25" for pliable surfaces. The projections can be in the form of nubs or fin segments that are arranged in rows oriented generally parallel or perpendicular to the longitudinal axis of the roller 40. In another embodiment, the textured surface of the outer sleeve of the roller 40 may be a pattern having a plurality of shallow dimples 58. The dimple pattern 58 is configured to provide a high density of dimples to maximize traction while minimizing the appearance of dimple marks in the fluid applied to the surface. Because the roller 40 surface is flexible, the dimples 58 deform under pressure for comfort during use. Whether grooves, projections, or dimples and without being bound by theory, it is believed the textured roller 40 will pick up a volume of fluid from the tray member 36. The textured surface also provides traction on the skin to allow the roller 40 to roll and not slide on the surface, even in slippery conditions during fluid application. Another benefit of the textured surface is its ability to further control lotion flow by providing space between the walls of the texture pattern during fluid uptake as the roller applicator passes across the surface of the upload tray channel 54, and then when under pressure of direct contact with the skin, deforming and displacing fluid in desired area of the skin.

The flexible outer sleeve of the roller 40 can be made by overmolding a soft material directly onto the rigid core 39 or by separately making the sleeve and affixing the sleeve to the rigid core 39. In the latter case, structural ridges and ribs molded directly onto the inner surface of the outer sleeve and the corresponding exterior surface of the inner core 39 maintain the parts in contact and reduce slippage of the sleeve relative to the inner core 39.

There are a number of materials suitable for use as the flexible surface of the outer sleeve of the roller 40 including, for example, silicone. However, chemicals in some sunscreens during sustained exposure interact poorly with silicone, causing it to expand slightly. Other materials suitable for forming the flexible surface of the outer sleeve and for use with sunscreen include ethylene propylene diene monomer (EPDM). EPDM also showed small amounts of expansion when exposed to certain sunscreen chemicals. Under sizing the inside diameter of the outer sleeve relative to the outside diameter of the rigid inner core 39 is preferable to limit the ability of the outer sleeve to move independently of the inner core and potentially interfere with the end-walls 48 and sidewalls 50. Such design modifications were prompted by the unanticipated expansion of the outer sleeve resulting from sustained contact of many sunscreen lotions with various common consumer polymers evaluated in outer sleeve testing.

Figure 14:
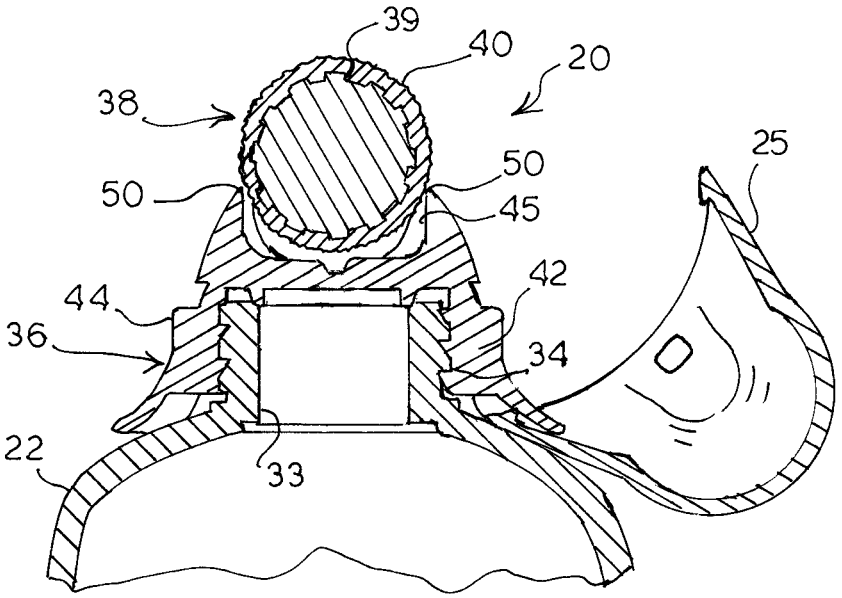
FIG. 14 is a transverse cross-section view of the fluid dispensing apparatus as shown in FIG. 1 with the cap secured to the apparatus.
Figure 15:
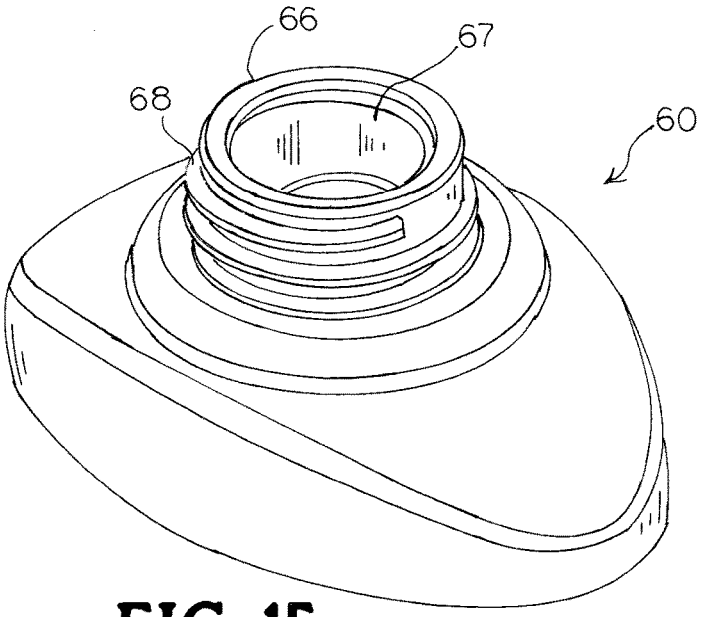
FIG. 15 is a top perspective view of an embodiment of an adaptor for use with an apparatus for dispensing fluid from a source of fluid.

The cap 25 (FIGS. 1-3) may be provided for covering the applicator assembly 26 when the fluid dispensing apparatus 20 is not in use. Features may be provided to enable the cap 25 to be attached to the applicator assembly 26, such as clips, flange edge, grooves, anchor points for latches, tabs, clips, magnets or other attachment means. In one embodiment, the cap 25 may be tethered to the housing 22 by the lanyard 24. The cap 25 may also have indentations, bumps, ridges, or other surface shapes or textures to provide grip points for fingers to aid in the process of cap 25 removal and replacement, and to provide dimensional stability after prolonged use and exposure to lotions and sunlight. Attachment means may also be used to enable the cap 25 to be attached to the housing 22 for temporary storage during fluid application. Referring to FIG. 14, the skirt 28 of the outer tray base 44 allows the cap 25 to be wedged between the applicator assembly 26 and the top of the housing 22 during use without interfering with the roller 40. A flange 29 on the inside of the cap 25 secures the cap in the storage position.

During use, the user compresses the housing 22 inward for forcing fluid to the roller 40 in rolling contact with the skin for dispensing fluid onto the skin. With this arrangement, the user is only required to bring the roller 40 into contact with the skin and apply pressure to the housing 22 for transferring the fluid to the upload tray 36 each time the housing 22 is depressed. The applicator assembly 26 disperses the fluid in a controlled manner necessary to achieve the uniform coverage of a surface desirable in some applications.

More particularly, the user grasps the housing 22 and places the roller 40 in contact with an area of skin or other surface to be covered with fluid. The user then compresses the housing 22. The pressure applied to the housing 22 reduces the volume of the housing 22, generating positive pressure. Due to the positive pressure in the housing 22, fluid in the housing 22 is forced through the pair of outlet ports 46 and into the channels 54 in the outer surface 45 of the tray base 44. The fluid is distributed laterally from the outlet ports 46 filling the channels 54 and the depression 55 in the tray base 44 between the outer surface 45 of the tray base 44 and the roller 40. The roller 40 rotates when the user moves the roller 40 along the skin. The fluid is then delivered to the skin as the roller 40 continues to rotate further while making contact with the skin. Squeezing the housing 22 thus provides a means for pressurizing fluid within the inner cavity 32 for forcing fluid from the housing 22 and delivering the fluid to the applicator assembly 26 for dispensing the fluid. The deformable housing 22 allows the user to closely regulate the amount of fluid flow at any time by changing the amount of pressure.

The upload tray 36 retains unused fluid in an area above the tray base 44 and beneath the roller 40 to reduce leakage that may otherwise result from excess fluid accumulating on the exposed surface of the applicator assembly 26. Such unused fluid is held in the channels 54 and the depression of the tray base 44 awaiting transfer to the roller 40 during rotation. As shown in FIG. 14, the edges of the side walls 50 of the tray base 44 are adjacent the roller 40. The rotating roller 40 picks up the fluid and draws the fluid past the edge of the side walls 50 of the tray member 54. The side walls 50 screen excess fluid from the rotating roller 40 creating a uniform layer when passing through a clearance between the side walls and the roller prior to dispensing fluid over the skin. The close fit of the roller 40 in the recess 52 of the tray base 44 is specifically configured and helps provide a more uniform fluid coating on the roller 40 and reduces fluid buildup on the edges of the tray base 44. With this arrangement, fluid flow and uptake on the roller 40 surface is restricted and more uniform along the length of the roller surface and its application to the skin is more efficient and reduces repetitive passage on the skin to place a uniform layer of fluid. It is understood that the applicator assembly 26 may make contact with the skin without activating the flow of fluid. This operating feature is desirable to provide the user with the ability to use the roller 40 to spread fluid that has already been discharged onto the skin.

When pressure is released from the deformable housing 22, the volume of the interior chamber 32 may increase generating negative pressure within the chamber 32. Due to the negative pressure, fluid and air may be drawn through the ports 46 in the tray base 44 and back into the housing 22. Once the housing 22 is empty, the housing may be replaced as the applicator assembly 26 is detachable from the housing 22, which renders the housing 22 easy to refill, clean, or replace. Another housing 22 containing fluid, such as sunscreen, may also be provided for replacement of a spent housing 22.

Figure 16:
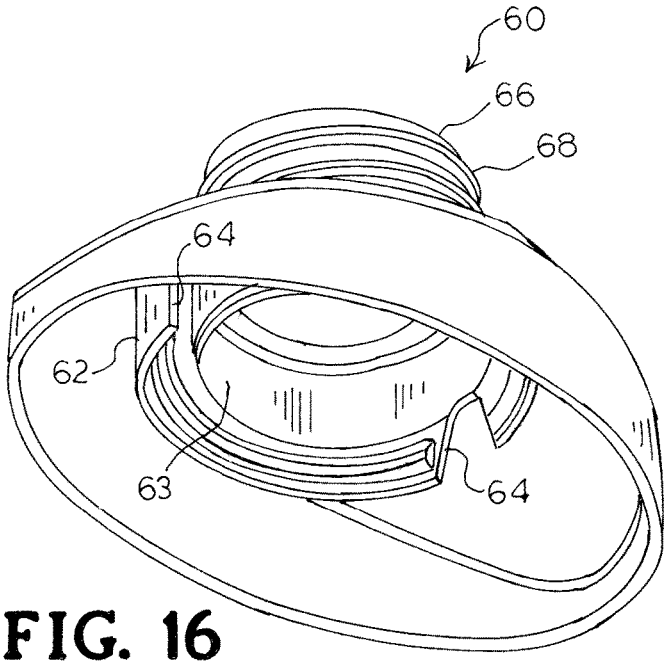
FIG. 16 is a bottom perspective view of the adaptor as shown in FIG. 15.
Figure 17:
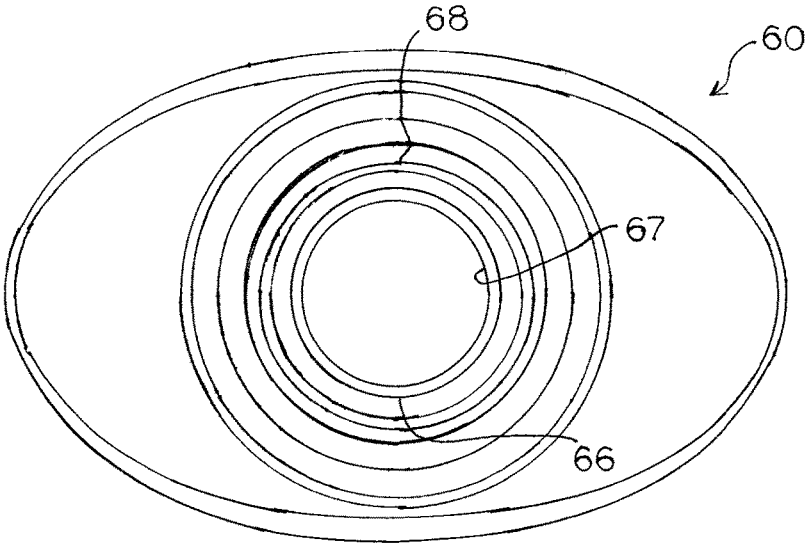
FIG. 17 is a top plan view of the adaptor as shown in FIG. 15.
Figure 18:
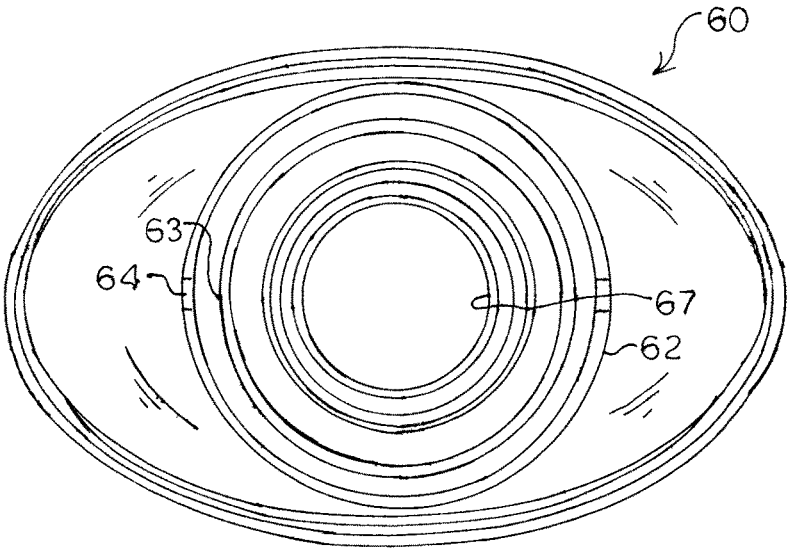
FIG. 18 is a bottom plan view of the adaptor as shown in FIG. 15.
Figure 19:
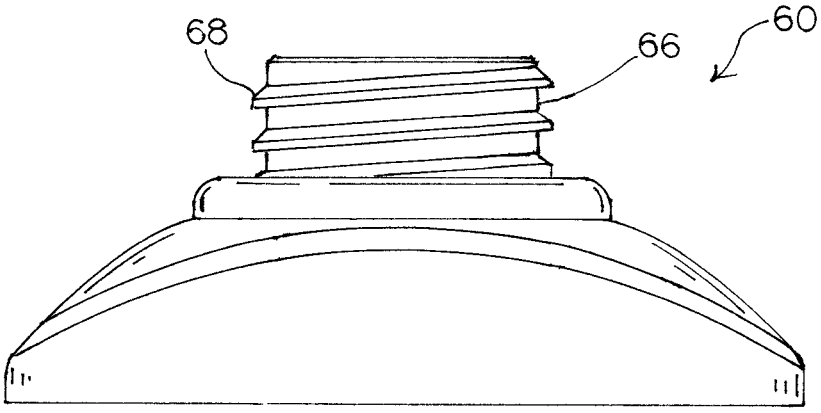
FIG. 19 is a front elevation view of the adaptor as shown in FIG. 15.
Figure 20:
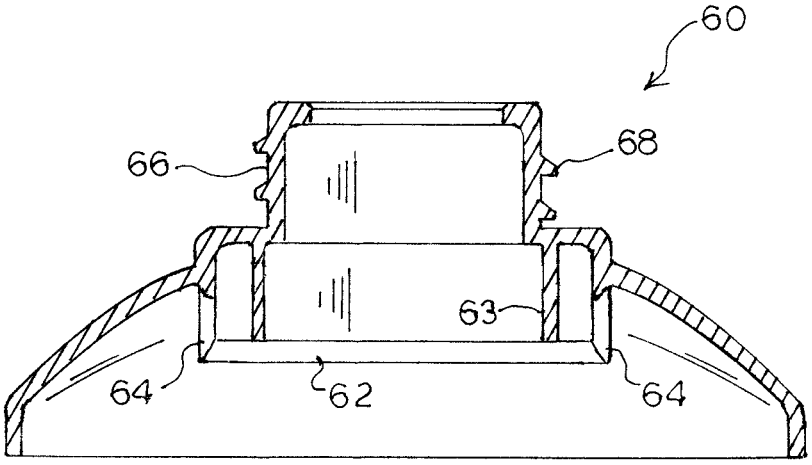
FIG. 20 is a longitudinal cross-section view of the adaptor as shown in FIG. 15.
Figure 21:
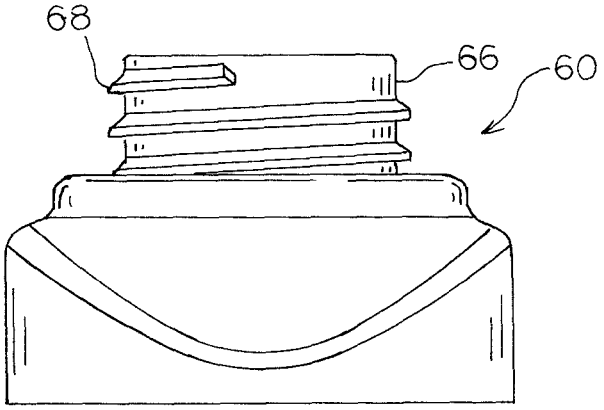
FIG. 21 is a side elevation view of the adaptor as shown in FIG. 15.
Figure 22:
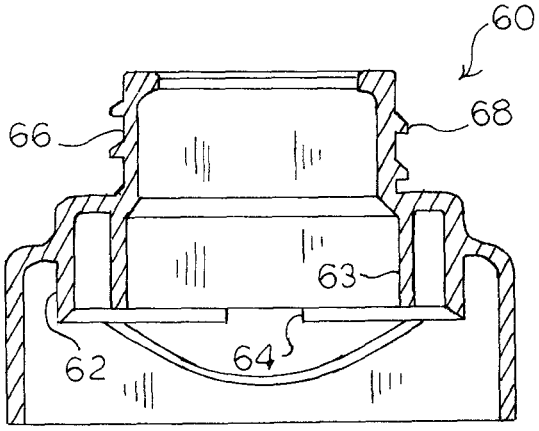
FIG. 22 is a transverse cross-section view of the adaptor as shown in FIG. 15.

Referring to FIGS. 15-22, an embodiment of an adaptor, generally designated at 60, is shown for an interference fit or a snap fit connection between the housing 22 the upload tray 36. The adaptor 60 is a generally ovular elongated member comprising an inner central attachment flange 62 (FIGS. 16, 18 and 20). The attachment flange 62 is cylindrical and defines a central axial bore 63 adapted for receiving the outer open end 34 of the housing 22. The attachment flange 62 is configured with an inner wall and an outer wall for securing the adapter 60 to the housing 22. This arrangement provides a seal against fluid leakage. The outer wall of the attachment flange 62 also has a pair of opposed notches 64 that interact with corresponding protrusions on the housing 22 attachment point and create leverage to aid in the removal of the adapter from the housing 22. The shape of the adapter 60 is configured for seating onto an existing indentation on the perimeter of a conventional snap top housing 22. This arrangement of the adapter 60 on the housing 22 creates resistance to leverage generated by the applicator assembly 26 during use and minimizes the possibility of becoming disconnected from the housing 22. This arrangement also prevents the adapter 60 from rotating at the connection point formed by the attachment flange 62 at the point where the attachment flange 62 contacts the housing 22. In the embodiment shown, the adaptor 60 further comprises an externally threaded outer flange 66 for removable threaded attachment to the upload tray 36.

Figure 23:
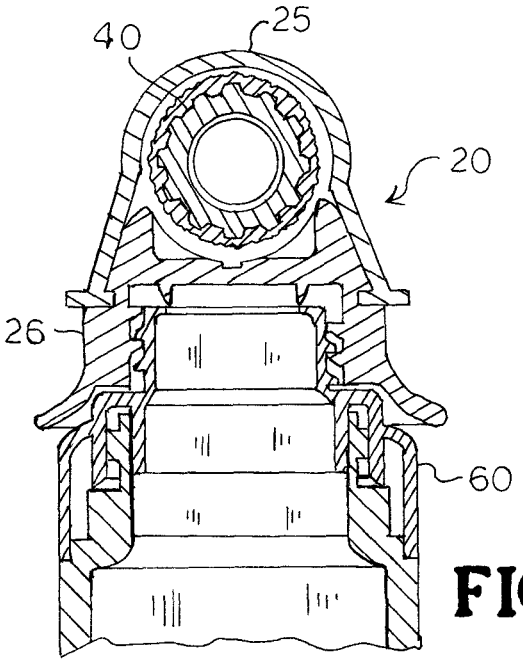
FIG. 23 is a transverse cross-section view of the adaptor as shown in FIG. 15 operably connected for fluid transfer between an embodiment of an apparatus for dispensing fluid and a source of fluid.
Figure 24:
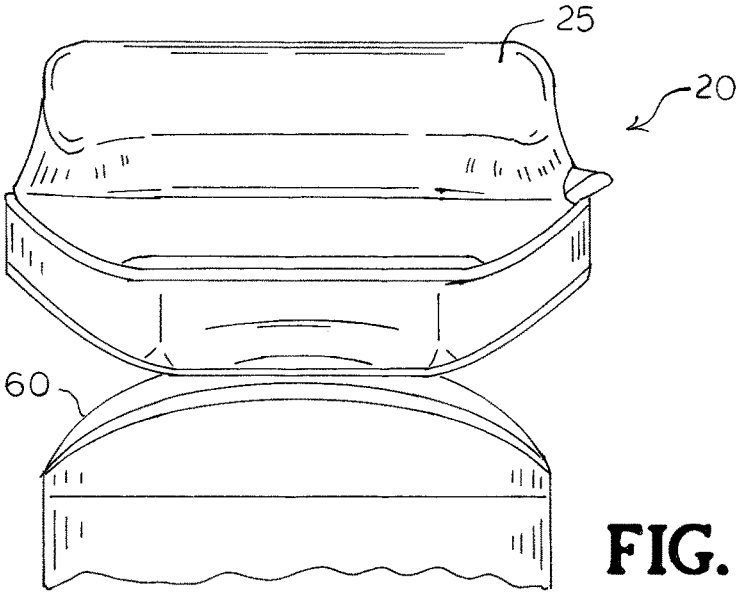
FIG. 24 is a front elevation view of the adaptor as shown in FIG. 23.
Figure 25:
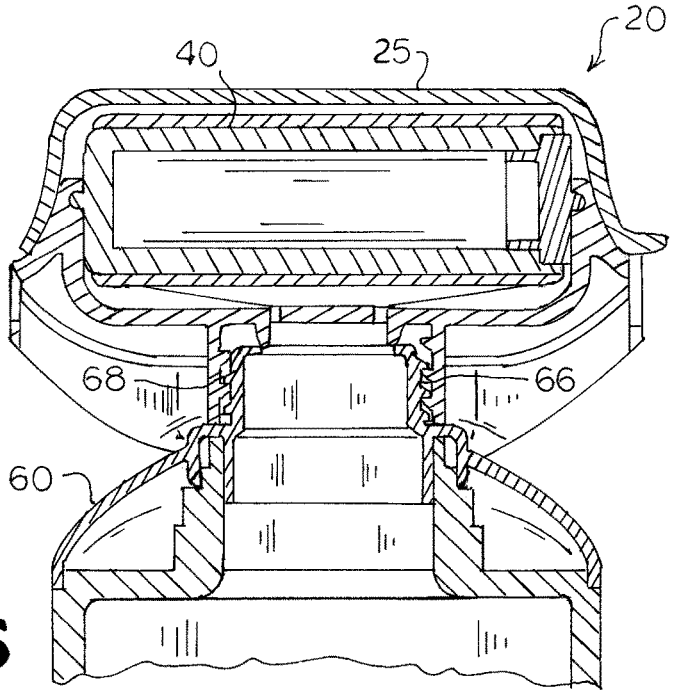
FIG. 25 is a longitudinal cross-section view of the adaptor as shown in FIG. 23.

Referring to FIGS. 23-25, the adapter 60 is shown in assembly with the applicator assembly 26 on a snap-top housing 22. The opening through the attachment flange 62 and the outer flange 66 allows for the fluid communication from the housing 22 to the upload tray 36 providing means for delivering fluid from the housing 22 through the attachment flange 62 to the outer tray base 44. The fluid is then delivered to the skin as the roller 40 rotates while making contact with the skin. Squeezing the housing 22 provides a means for pressurizing fluid within the inner cavity 32 for forcing fluid from the housing 22 and delivering the fluid through the adaptor 60 to the applicator assembly 26 for dispensing the fluid.

The adapter 60 enables the applicator assembly 26, which in one embodiment is configured for threaded attachment, to be fixable to a snap-top housing 22 through the adaptor 60. The adapter 60 thus increases the convenience to the user by allowing a single upload tray to operate with more than one type of conventional housing 22. The sidewalls of the adapter 60 are configured with sufficient profile to provide a space between the sidewalls and the adaptor 60 to be used for the cap 25 to be attached to the housing 22 for temporary storage during fluid application. The adaptor 60 allows the cap 25 to be wedged between the adaptor 60 and the housing during use without interfering with the roller 40. A flange 29 on the inside of the cap 25 secures the cap in the storage position.

The fluid dispensing apparatus 20 may be used to apply, for example, sun screen or other body lotions. Other suitable fluids may include skin care compositions suitable for topical application, including, for example, shaving gels, lubricants, shaving foams, shaving lotions, shave oils, skin treatment compositions and creams, astringents, exfoliant scrubs, sun screens, cleansers, skin conditioning aids, ointments, imaging agents applied to the skin surface, depilatories, balms, lotions, moisturizers, fragrances, anesthetic lotions, and combinations thereof. Other fluids unrelated to personal care to be dispensed may include paints, adhesives, solvents, and other materials of a viscosity similar to that of commonly-used sun screens presently available. Further, other fluids with viscosities dissimilar to commonly-used sun screens may be delivered with the apparatus. This is possible by making readily apparent modifications in port sizes, and other dimensions and materials of the apparatus as described.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. Moreover, the fluid dispensing apparatus can be made to dispense any fluid, such as paints, oils, and the like. Accordingly, we intend to cover all such modifications, omissions, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. An apparatus for dispensing a fluid from a source of fluid onto a surface, the fluid dispensing apparatus comprising:

a roller; and a tray member having an outer surface defining a pair of ports and a pair of longitudinally spaced elongated channels extending along a central longitudinal axis of the tray member, wherein one port of the pair of ports opens into each of the channels for providing fluid communication between the source of fluid and the tray member and delivering fluid from the fluid source to the outer surface of the tray member, the tray member comprising a pair of spaced walls having a contiguous tapered inner surface for defining an arcuate recess, the inner surface tapering to an outer edge of each wall, and means for mounting the roller, the roller mounting means including a pair of resilient spaced arms, each one of the arms spanning between and interconnecting the ends of the spaced walls, wherein the roller is rotatably mounted to the spaced arms for receiving fluid from the outer surface of the tray member and applying the fluid onto the surface.

2. The fluid dispensing apparatus as recited in claim 1, wherein the roller is made of elastic material.

3. The fluid dispensing apparatus as recited in claim 1, wherein the roller comprises a solid core.

4. The fluid dispensing apparatus as recited in claim 1, wherein the roller may be removed from the tray member by manually spreading the arms.

5. The fluid dispensing apparatus as recited in claim 1, wherein the depth of the channels increases as the channels extend outwardly from an inner end to an outer end.

6. The fluid dispensing apparatus as recited in claim 1, wherein the channels are equally spaced from a midpoint of the central longitudinal axis of the tray member.

7. The fluid dispensing apparatus as recited in claim 1, wherein the each port of the pair of ports is adjacent an inner end of the channel.

8. The fluid dispensing apparatus as recited in claim 1, wherein the outer surface of the tray member opens into hourglass-shaped depression extending along the central longitudinal axis of the tray member, and wherein the pair of channels opens into the depression.

9. The fluid dispensing apparatus as recited in claim 8, wherein the depression has a constant depth.

10. The fluid dispensing apparatus as recited in claim 8, wherein the midpoint of the central longitudinal axis of the depression is coincident with the midpoint of the central longitudinal axis of the tray member.

11. The fluid dispensing apparatus as recited in claim 8, wherein the outer ends of the depression are coincident with the outer ends of the channels.

12. An apparatus for dispensing a fluid, the fluid dispensing apparatus comprising:

a housing defining an interior adapted to hold the fluid and having an opening into the interior, the housing formed from a flexibly resilient material for transferring fluid from the housing via the opening by varying pressure on the housing;

a fluid applicator assembly mounted on the housing in fluid communication with the opening into the interior of the housing for delivering the fluid to the applicator assembly, the applicator assembly including a fluid delivery element which is held in contact against a surface for applying the fluid onto the surface, and a tray member having an outer surface defining a pair of ports and a pair of spaced elongated channels extending along a central longitudinal axis of the tray member, wherein one port of the pair of ports opens into each of the channels for providing fluid communication between the source of fluid and the tray member and delivering fluid from the fluid source to the outer surface of the tray member, the tray member comprising a pair of spaced walls having a contiguous tapered inner surface for defining an arcuate recess, the inner surface tapering to an outer edge of each wall, and means for mounting the fluid delivery element, wherein the pressure on the housing reduces the volume of the interior for forcing fluid to the fluid applicator assembly such that fluid is delivered to the fluid delivery element for dispensing the fluid onto the surface.

13. The apparatus for dispensing a fluid as recited in claim 12, wherein the fluid delivery element comprises a roller assembly including a roller rotatably mounted to the mounting means.

14. The apparatus for dispensing a fluid as recited in claim 13, wherein the roller is made of elastic material.

15. The apparatus for dispensing a fluid as recited in claim 14, wherein the roller comprises a solid core.

16. The fluid dispensing apparatus as recited in claim 12, wherein the depth of the channels increases as the channels extend outwardly from an inner end to an outer end.

17. The fluid dispensing apparatus as recited in claim 12, wherein the channels are equally spaced from a midpoint of the central longitudinal axis of the tray member.

18. The fluid dispensing apparatus as recited in claim 12, wherein the each port is adjacent an inner end of the channel.

19. The fluid dispensing apparatus as recited in claim 12, wherein the outer surface of the tray member opens into hourglass-shaped depression extending along the central longitudinal axis of the tray member, and wherein the pair of channels opens into the depression.

20. The fluid dispensing apparatus as recited in claim 19, wherein the depression has a constant depth.

21. The fluid dispensing apparatus as recited in claim 19, wherein the midpoint of the central longitudinal axis of the depression is coincident with the midpoint of the central longitudinal axis of the tray member.

22. The fluid dispensing apparatus as recited in claim 19, wherein the outer ends of the depression are coincident with the outer ends of the channels.

* * * * *